US007319834B2

(12) United States Patent
Yamaguchi

(10) Patent No.: US 7,319,834 B2
(45) **Date of Patent: *Jan. 15, 2008**

(54) PROCESS CARTRIDGE AND IMAGE FORMING APPARATUS

(75) Inventor: Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/611,974

(22) Filed: Dec. 18, 2006

(65) Prior Publication Data

US 2007/0098438 A1 May 3, 2007

Related U.S. Application Data

(62) Division of application No. 11/094,242, filed on Mar. 31, 2005, now Pat. No. 7,194,225.

(30) Foreign Application Priority Data

Mar. 24, 2005 (JP) ..... 2005/086041

(51) Int. Cl.
*G03G 21/16* (2006.01)

(52) U.S. Cl. ..... 399/111; 399/113

(58) Field of Classification Search ..... 399/111, 399/113, 167, 126

See application file for complete search history.

(56) References Cited

U.S. PATENT DOCUMENTS 5,099,278 A * 3/1992 Sato
5,890,036 A 3/1999 Karakama et al. ..... 399/113
6,542,706 B2 4/2003 Toba et al. ..... 399/111
6,681,088 B2 1/2004 Kanno et al. ..... 399/111
6,782,219 B2 8/2004 Yoshino et al. ..... 399/90
6,834,173 B2 12/2004 Yamaguchi et al. ..... 399/119
6,882,811 B2 4/2005 Fukuda et al. ..... 399/111

(Continued)

FOREIGN PATENT DOCUMENTS

EP 1 510 888 A1 3/2005

(Continued)

OTHER PUBLICATIONS

European Search Report, dated Nov. 29, 2005 in EP Application No. 05 00 7645.4.

(Continued)

*Primary Examiner*—Susan Lee
(74) *Attorney, Agent, or Firm*—Fitzpatrick, Cella, Harper & Scinto

(57) ABSTRACT

A process cartridge detachably mountable to a main assembly of an electrophotographic image forming apparatus, includes an electrophotographic photosensitive drum, a developing roller for developing a latent image formed on the drum while in contact with the drum, a drum unit supporting the drum, a developing unit supporting the developing roller and movable with the drum unit between contact and spaced apart positions in which the developing roller and the drum contact or are spaced from each other, a drum driving force receiving portion, a movable member to move the developing unit between the contact position and the spaced position, and a movable member driving force receiving portion provided for receiving, from the main assembly, a movable member driving force for moving the movable member when the process cartridge is mounted in the main assembly.

8 Claims, 12 Drawing Sheets

U.S. PATENT DOCUMENTS

| | | | | |
|---|---|---|---|---|
| 6,915,092 | B2 | 7/2005 | Yamaguchi et al. | 399/109 |
| 6,947,687 | B2 | 9/2005 | Yamaguchi et al. | 399/111 |
| 6,961,528 | B2 | 11/2005 | Yamaguchi et al. | 399/119 |
| 6,983,115 | B2 | 1/2006 | Isobe et al. | 399/119 |
| 7,068,965 | B2 | 6/2006 | Yoshino et al. | 399/119 |
| 2002/0110386 | A1 | 8/2002 | Kanno et al. | 399/111 |
| 2003/0161655 | A1 | 8/2003 | Fukuda et al. | 399/111 |
| 2005/0047820 | A1 | 3/2005 | Hoshi et al. | 399/111 |
| 2005/0220099 | A1 | 10/2005 | Igarashi | 370/389 |
| 2005/0220481 | A1 | 10/2005 | Yamaguchi et al. | 399/111 |

FOREIGN PATENT DOCUMENTS

| | | |
|---|---|---|
| EP | 1 515 198 A2 | 3/2005 |
| JP | 7-56491 | 3/1995 |
| JP | 7-234552 | 9/1995 |
| JP | 2001-13762 | 1/2001 |
| JP | 2001-337511 | 12/2001 |
| JP | 2003-167499 | 6/2003 |
| JP | 2003-323017 | 11/2003 |

OTHER PUBLICATIONS

Jul. 4, 2007 European Office Action in European Application No. 05 007 645.4-1240.

* cited by examiner

PROCESS CARTRIDGE AND IMAGE FORMING APPARATUS

CROSS-REFERENCE TO RELATED APPLICATION

The present application is a Divisional Application of U.S. application Ser. No. 11/094,242 filed Mar. 31, 2005 now U.S. Pat. No 7,194,225 allowed.

FIELD OF THE INVENTION AND RELATED ART

The present invention relates to an electrophotographic image forming apparatus and a process cartridge detachably mountable to a main assembly of the electrophotographic image forming apparatus.

Here, the electrophotographic image forming apparatus is an apparatus forming an image on a recording material (for example, plain paper, OHP sheet or the like) using an electrophotographic-image-formation-type method. The electrophotographic image forming apparatus includes an electrophotographic copying machine, an electrophotographic printer (for example a laser beam printer, an LED printer or the like), a facsimile machine, a word processor and the like.

One of developing systems usable with such an electrophotographic image forming apparatus is contact developing system. In the contact developing system, an electrostatic latent image formed on a photosensitive drum is developed with a developer while the developing roller contacts the photosensitive drum. If the developing roller is maintained in contact with the photosensitive drum in the contact developing system for a long term, the developing roller is liable to deform.

In order to solve this problem, it is known that developing roller and the photosensitive drum are spaced from each other except at the time of image forming operation (Japanese Laid-open Patent Application No. 2001-337511). Here, with this structure, the trigger for separating the developing roller from the photosensitive drum is provided in the main assembly of the electrophotographic image forming apparatus. The developing roller and the photosensitive drum are provided in an image forming unit. The image forming unit is detachably mountable to the main assembly of the apparatus. The image forming unit comprises a developing unit for rotatably supporting the developing roller and a drum unit for rotatably supporting the photosensitive drum. In the state in which the image forming unit is set in the main assembly of the apparatus, the trigger pushes the developing unit except during the image forming operation. By this arrangement, the developing unit moves relative to the drum unit. As a result, the developing roller is separated from the photosensitive drum.

However, the provision of the trigger in the main assembly of the apparatus involves a problem. That is, the positional accuracy between the trigger and the developing unit has to be considered.

SUMMARY OF THE INVENTION

Accordingly, it is a principal object of the present invention to provide a process cartridge and an electrophotographic image forming apparatus wherein when the process cartridge is set in the main assembly of the electrophotographic image forming apparatus, the positional accuracy between a movable member for moving the developing unit and the developing unit, is improved.

It is another object of the present invention to provide a process cartridge and an electrophotographic image forming apparatus wherein the load required for mounting the process cartridge to the main assembly of the electrophotographic image forming apparatus is light.

It is a further object of the present invention to provide a cartridge detachably mountable to a main assembly of an electrophotographic image forming apparatus. The process cartridge comprises an electrophotographic photosensitive drum; a developing roller for developing an electrostatic latent image formed on the electrophotographic photosensitive drum with a developer while being in contact with the electrophotographic photosensitive drum; a drum unit for support the electrophotographic photosensitive drum, wherein the drum unit is positioned relative to the main assembly of the apparatus when the process cartridge is set in the main assembly of the apparatus; a developing unit supporting the developing roller and movable together with the drum unit between a contact position in which the developing roller and the electrophotographic photosensitive drum are in contact to each other to develop the electrostatic latent image and a spaced position in which the developing roller and the electrophotographic photosensitive drum are spaced away from each other; a drum driving force receiving portion, provided in the drum unit, for receiving, from the main assembly of the apparatus, a drum driving force for rotating the electrophotographic photosensitive drum when the process cartridge is set in the main assembly of the apparatus; a movable member which is movable to move the developing unit between the contact position and the spaced position; and a movable member driving force receiving portion provided in the drum unit for receiving, from the main assembly of the apparatus, a movable member driving force for moving the movable member when the process cartridge is mounted in the main assembly of the apparatus.

These and other objects, features and advantages of the present invention will become more apparent upon a consideration of the following description of the preferred embodiments of the present invention taken in conjunction with the accompanying drawings

DESCRIPTION OF THE PREFERRED EMBODIMENTS

Structure of Electrophotographic Image Forming Apparatus

Figure 1:
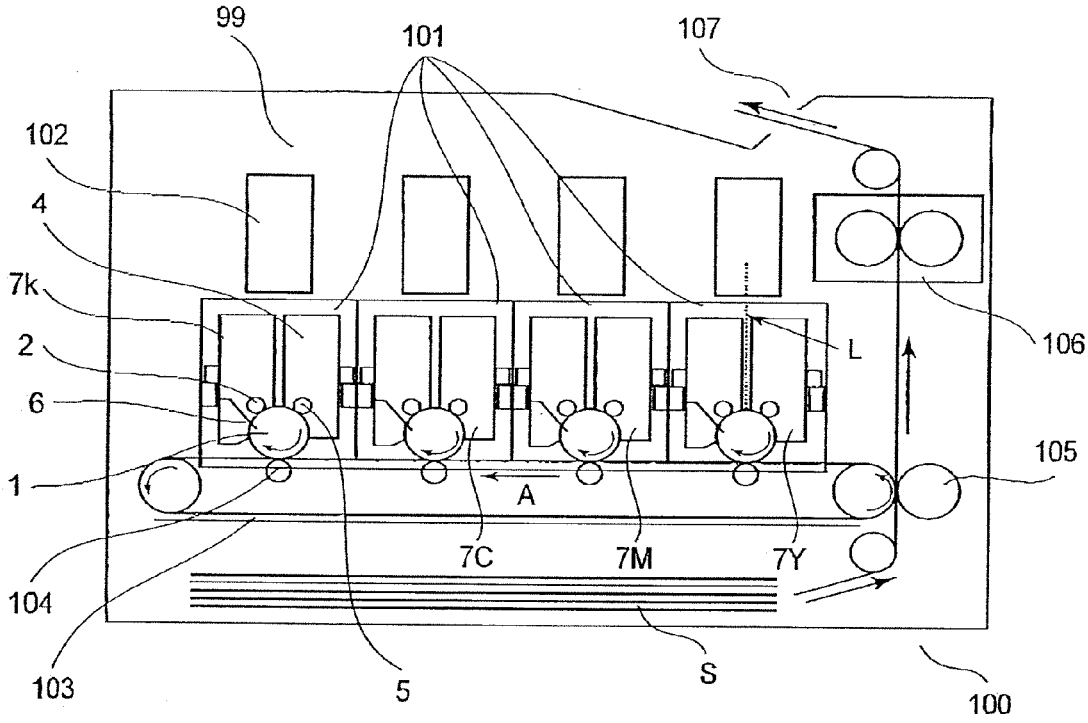
FIG. 1 is a sectional view of an electrophotographic image forming apparatus according to an embodiment of the present invention.
Figure 2:
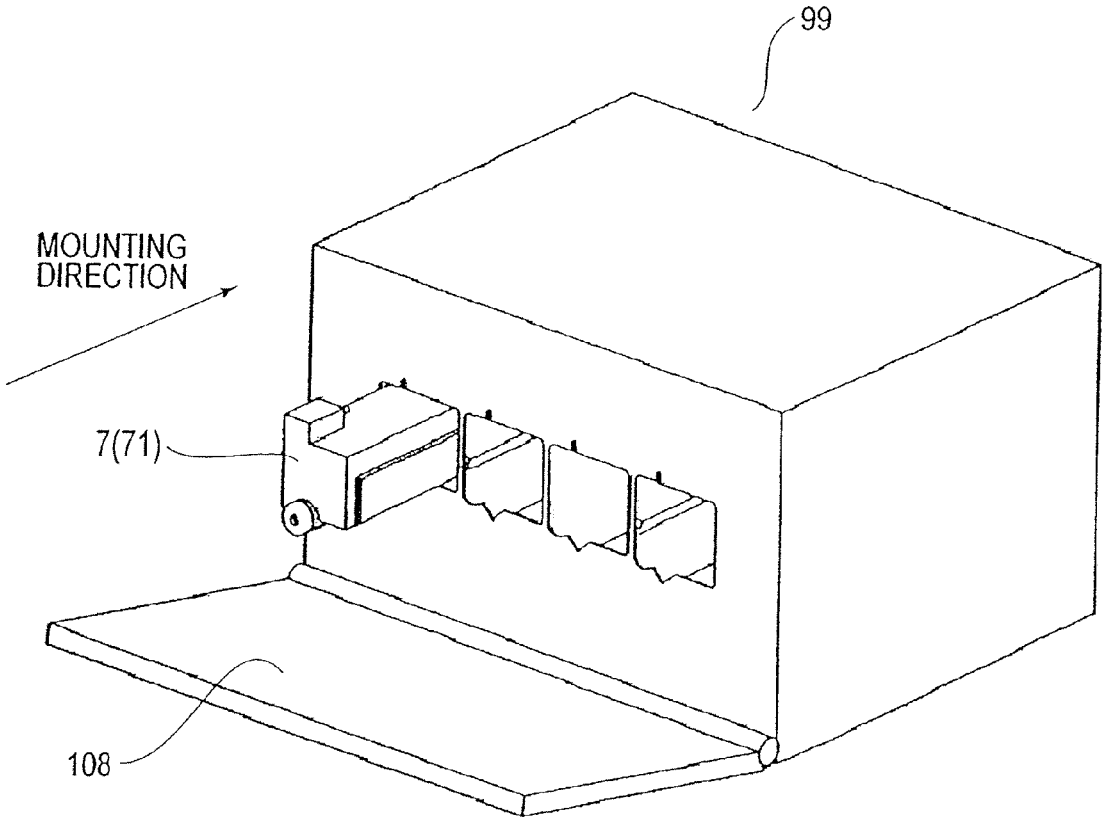
FIG. 2 is a perspective view of an electrophotographic image forming apparatus according to an embodiment of the present invention.

Referring to FIG. 1, description will be provided as to an electrophotographic image forming apparatus 100 to which a process cartridge 7 is detachably mountable, according to an embodiment of the present invention. The main assembly 99 of the image forming apparatus 100 is provided with four cartridge mounting portions 101 for detachably mounting the cartridges 7 (7Y, 7M, 7C, 7Bk). The mounting portions 101 are arranged in parallel in the horizontal direction when the main assembly 99 of the apparatus is installed. Each of the cartridges 7 (7Y, 7M, 7C, 7Bk) has one electrophotographic photosensitive drum. A cartridge 7Y accommodates a yellow developer. A cartridge 7M accommodates a magenta developer. A cartridge 7C accommodates a cyan developer. A cartridge 7Bk accommodates a black developer. In this embodiment, the developer is a non-magnetic one component toner. The cartridges 7 are arranged in the order of 7Y, 7M, 7C and 7K from the upstream portion of the cartridge toward the downstream portion of the cartridge with respect to a direction of an image formation process, namely the direction indicated by an arrow A in the figure, that is, in the moving direction of a transfer belt 103, which will be described hereinafter. The photosensitive drum 1 rotates in the clockwise direction by a drive transmitting portion 120 provided in the main assembly 99 of the apparatus. Around the photosensitive drum 1, there are provided a charging roller 2, a scanner unit 102, a developing unit 4 and a transfer belt 103 in the order named with respect to the rotational direction thereof. The charging roller 2 contacts the photosensitive drum 1 to uniformly charge the peripheral surface of the photosensitive drum 1. The scanner unit 102 projects a laser beam L onto the peripheral surface of the photosensitive drum 1 on the basis of image information. As a result, an electrostatic latent image is formed corresponding to the image information on the peripheral surface of the photosensitive drum 1. The developing unit 4 rotatably supports the developing roller 5. The developing roller 5 develops the electrostatic latent image with a developer. The transfer belt 103 is rotated while contacting to the photosensitive drum 1. A developed image provided on the photosensitive drum 1 by the developing means is electrostatically transferred onto the transfer belt 103. The cleaning means 6 removes the developer remaining on the peripheral surface of the photosensitive drum 1 after the image transfer. The photosensitive drum 1, the charging roller 2, the developing unit 4 and the cleaning means 6 are constituted into a unit (cartridge).

A primary transfer roller 104 is provided at a position opposed to the photosensitive drum 1 with the transfer belt 103 interposed therebetween. The primary transfer roller 104 urges the transfer belt 103 to the photosensitive drum 1. At a righthand side in FIG. 1, the transfer belt 103 is disposed opposed to the transfer roller 105 and is contacted thereto. The recording material S passes through the contact portion where the transfer belt 103 is contacted to the secondary transfer roller 105. The developed image is transferred onto the recording material S from the transfer belt 103 at the contact portion.

Operation of Image Formation

The image forming operation will be described. The photosensitive drums 1 of the cartridges 7 are rotated at respective timing on the basis of image formations by a drive transmitting portion 120 provided in the main assembly 99 of the apparatus. Initially, the developing roller 5 is separated from the photosensitive drum 1. However, the developing roller 5, while rotating, is brought into contact to the photosensitive drum 1 at a proper timing with the image formation. When a full-color image is to be formed, the contacting operations between the developing rollers 5 and the photosensitive drums 1 are carried out in the order of the cartridge 7Y, the cartridge 7M, the cartridge 7C and the cartridge 7Bk. When the full-color image forming operation is to be stopped, the separating operations between them are carried out in the same order. When a monochromatic image is to be formed, the contacting operation is effected only in the cartridge 7Bk at the start of the image formation, and the separating operation is effected only in the cartridge 7Bk. The structure for contacting the developing roller 5 to the photosensitive drum 1 and for separating them, and the structure for the drive transmission will be described in detail hereinafter. Then, the scanner units 102 are driven for the respective cartridges 7. The charging roller 2 is rotated by the rotation of the photosensitive drum 1. And, the charging roller 2 is supplied with a charging bias. As a result, the peripheral surface of the photosensitive drum 1 is uniformly charged electrically. The scanner unit 102 projects a laser beam L in accordance with the image information onto the peripheral surface of the photosensitive drum 1. By this, an electrostatic latent image is formed on the peripheral surface of the photosensitive drum 1. The developing roller 5 rotatably supported on the developing unit 4 develops the electrostatic latent image with a developer. By an electric field formed between each of the photosensitive drums 1 and the associated primary transfer roller 104, the developed image formed on the photosensitive drum 1 is sequentially transferred onto the transfer belt 103. Thereafter, the developed images of four colors thus transferred onto the transfer belt 103, are transferred onto the recording material S by an electric field formed between the transfer belt 103 and the secondary transfer roller 105. Then, the recording material S is fed into the fixing portion 106. In the developed image, the developed image is heat-fixed on the recording material S. Then, the recording material S is discharged to the outside of the image forming apparatus 100 through the discharging portion 107.

Mounting of Process Cartridge to Main Assembly of the Electrophotographic Image Forming Apparatus A description will be provided as to the mounting of the cartridge 7 to the main assembly 99 of the apparatus. At the front side of the main assembly 99 of the apparatus, a main assembly cover 108 is provided. Inside the main assembly cover 108, there is provided a cartridge mounting portion 101 for mounting the cartridge 7. The cartridge 7 is mounted in the longitudinal direction of the cartridge 7 (the same direction as the longitudinal directions of the photosensitive drum 1 and the developing roller 5) into the mounting portion 101.

Process Cartridge

Figure 3:
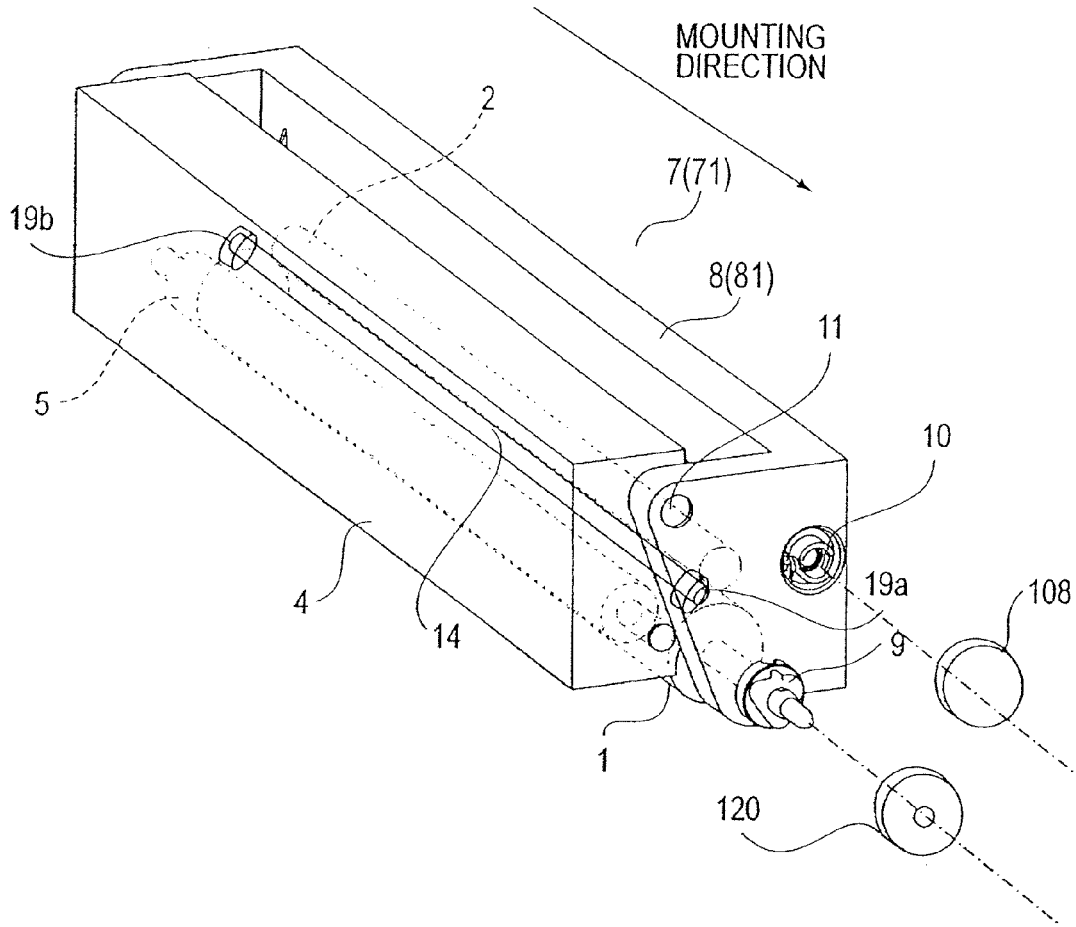
FIG. 3 shows an outer appearance of a process cartridge according to an embodiment of the present invention.

A description will be provided as to the process cartridge 7. FIG. 3 is a perspective view of the cartridge 7. The cartridge 7 comprises a drum unit 8 and a developing unit 2. The drum unit 8 contains the photosensitive drum 1, the charging roller 2 and the cleaning means 6. The drum unit 8 rotatably supports the photosensitive drum 1 and the charging roller. The developing unit 2 rotatably supports the developing roller 5. At the opposite ends of the drum unit 8, supporting portions 11 are provided, respectively to rotatably support the developing unit 4. The drum unit 8 swingably supports the developing unit 4 through a shaft 30 provided on the supporting portion 11. In other words, the developing unit 4 is movable relative to the drum unit 8. Further in other words, the developing unit 4 and the drum unit 8 are rotatably connected by the shaft 30 projecting through the supporting portion 11. The cartridge 7 includes a spring 12 (urging member) for applying an urging force (elastic force) between the drum unit 8 and the developing unit 4. The spring 12 has one end mounted to the drum unit 8 and the other end mounted to the developing unit 4. By the urging force, the developing roller 5 and the photosensitive drum 1 are contacted to each other. Here, the urging member is a spring, but this is not inevitable, and it may be another member if an urging force is applied between the units.

A drum driving force receiving portion 9 is provided at a leading end portion of the drum unit 8 with respect to the mounting direction of the cartridge 7 relative to the main assembly 99 of the apparatus. The driving force receiving portion 9 projects frontwardly beyond the frame 81 of the drum unit 8 with respect to the mounting direction. In this embodiment, the driving force receiving portion 9 is in the form of a coupling member (cartridge side coupling member). The coupling member has a non-circular twisted projection having a cross-section with plurality of corner portions. The main assembly 99 of the apparatus is provided with a driving force transmitting portion 120. In this embodiment, the driving force transmitting portion 120 is in the form of a coupling member (main-assembly side coupling member). The coupling member is a non-circular twisted hole having a cross-section having a plurality of corner portion. In the state that the cartridge 7 is mounted to the main assembly of the apparatus, the driving force receiving portion 9 receives a driving force for rotating the photosensitive drum 1 through the driving force transmitting portion. More particularly, when the cartridge 7 is mounted to the main assembly 99 of the apparatus, the twisted projection and the twisted hole are engaged to transmit the driving force from the driving force transmitting portion 120 to the driving force receiving portion 9. In this embodiment, by the engagement of the coupling members with each other, the drum driving force for rotating the photosensitive drum 1 is received from the main assembly 99 of the apparatus. The coupling member is brought into engagement by longitudinal relative motion, and therefore, the coupling structure does not obstruct the mounting of the cartridge 7.

A leading side of the drum unit 8 with respect to the mounting direction is provided with a movable member driving force receiving portion 10 which is rotatably mounted thereon. In this embodiment, the driving force receiving portion 10 uses a coupling mechanism. Here, the driving force receiving portion 10 and the driving force receiving portion 9 are independent from each other. The driving force receiving portion 10 is disposed at a position behind the frame 81 of the drum unit 8 with respect to the mounting direction. More particularly, the driving force receiving portion 10 is disposed in the frame 81 of the drum unit 8. The driving force receiving portion 10 is disposed behind the driving force receiving portion 9 with respect to the mounting direction. By doing so, the driving force receiving portion 10 can stably receive the driving force. The driving force receiving portion 10 receives, from the main assembly 99 of the apparatus, a driving force for moving the developing unit 4 so as to contact the developing roller 5 and the photosensitive drum 1 to each other and to space them away from each other. The driving force receiving portion 10 has projections 10*a*, 10*b* which are projected toward the leading side with respect to the mounting direction. The projections 10*a*, 10*b* are exposed to the outside of the frame 81 of the drum unit 8. The driving force receiving portion 10 has a gear portion 10*c*. The gear portion 10*c* is disposed behind the projections 10*a*, 10*b* with respect to the mounting direction. The gear portion 10*c* transmits the driving force received by the driving force receiving portion 10 to a cam 19 which will be described hereinafter. A drive transmission structure for contacting the photosensitive drum 1 and the developing roller 5 to each other and spacing them away from each other, will be described hereinafter.

Structure for Contact and Separation of Developing Roller

Figure 4:
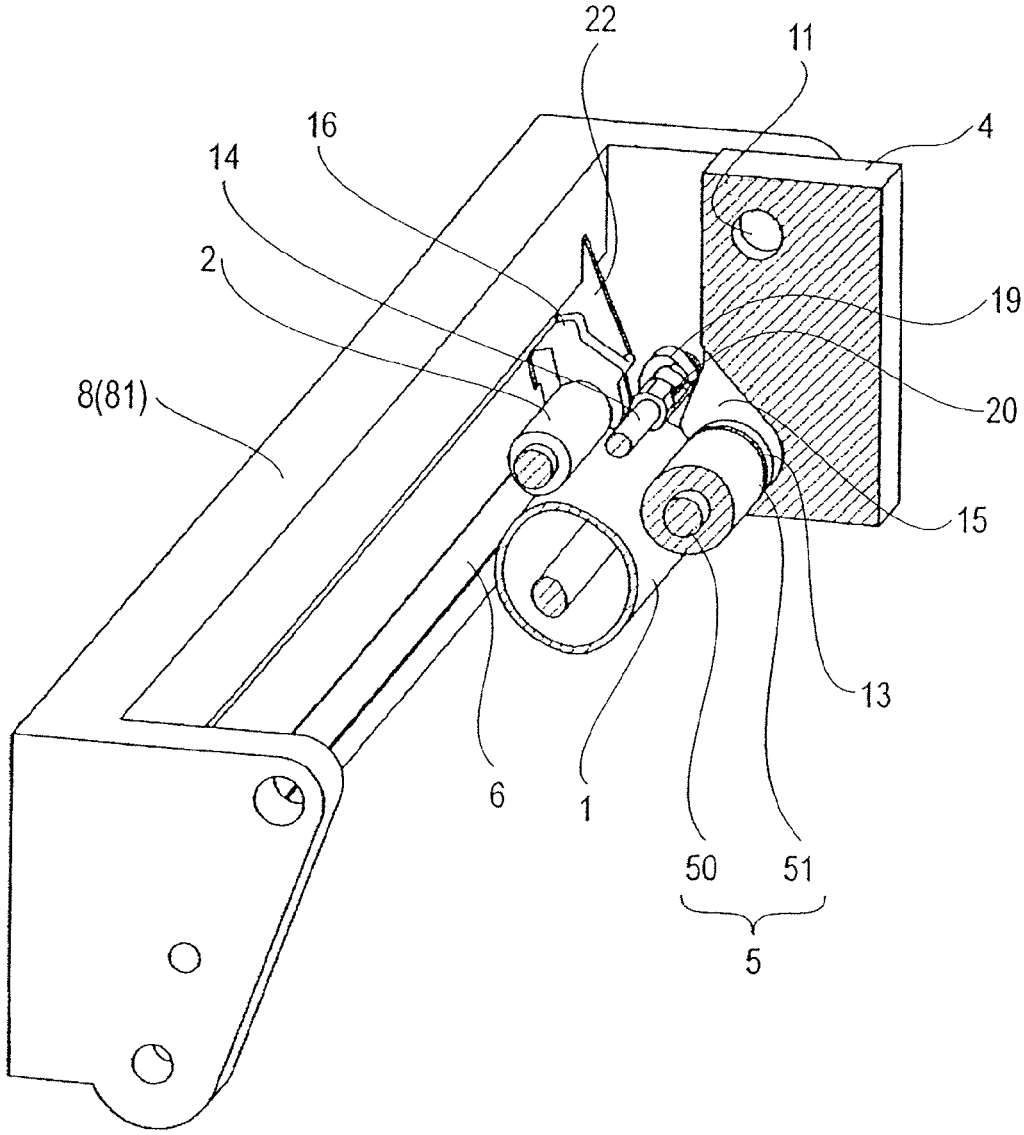
FIG. 4 is a perspective view showing a section of a process cartridge according to an embodiment of the present invention.

FIG. 4 is a view of the cartridge 7 as seen from the inside thereof. FIG. 4 shows the photosensitive drum 1 which is partly broken away. FIG. 4 shows one longitudinal end portion of the cartridge 7, but the structure is similar thereto at the other end. In this embodiment, the structures of the cartridges 7 for the respective colors are the same except for the colors of the toner contained therein.

The developing roller 5 comprises a metal shaft 50 and an elastic member 51 coating the peripheral surface of the metal shaft 50. The shaft 50 and the elastic member 51 are integrally molded, for example. The elastic member 51 may be a solid rubber monolayer or a solid rubber layer coated with a resin material.

A cylindrical roller 13 is rotatably provided at the opposite ends of the metal shaft 50. The roller 13 has an outer diameter which is slightly smaller than an outer diameter of the developing roller 5. The roller 13 is kept contacted to the peripheral surface of the photosensitive drum 1 during the image forming operation. By doing so, an entering degree (depth of impression) of the photosensitive drum 1 into the elastic member 51 is maintained at a predetermined level.

Between the developing unit 4 and the drum unit 8, a cam 19 (movable member) is provided. More particularly, as seen in the mounting direction, the cam 19 is disposed substantially between the developing roller 5 and the charging roller 2. Further particularly, as seen in the mounting direction, the cam 19 is disposed in a region enclosed by an axis of the developing roller 5, the axis of the charging roller 2, the axis of the photosensitive drum 1 and the axis of the shaft 11 (a region R enclosed by chain line in FIGS. 6, 7). By doing so, the cam 19 does not require an additional space therefor. This downsizes the cartridge 7. This leads to downsizing of the main assembly 99 of the apparatus. The drum unit 8 is provided with a shaft 14 extending parallel to the photosensitive drum 1. The shaft 14 extends from one end to the other end of the drum unit 8 along the drum unit 8. The cam 19 (19*a*, 19*b*) is provided at each of one and the other end ends of the shaft 14 with respect to the longitudinal direction thereof. The opposite ends of the shaft 14 are rotatably supported by the frame of the drum unit 8. More particularly, in the longitudinal direction of the shaft 14, it is supported by the frame 81 of the drum unit 8 at positions outside the cam 19. In other words, the cam 19 is provided inside the frame 81 of the drum unit 8 with respect to the longitudinal direction. By such a disposition of the cam 19, the cartridge 7 is downsized. The laser beam L projected from the scanner unit 102 passes through between the charging roller 2 and the shaft 14. The cam 19 faces a surface 15 to be pressed provided on a side surface of the developing unit 4 at the end portions of the developing unit 4 with respect to the longitudinal direction. The shaft 14 is provided with a projection 20. The projection 20 is disposed at a position nearer to a center shifting portion of the cartridge 7, shifting with respect to the longitudinal direction of the shaft 14, than the cam 19. The projection 20 functions to release the contact between the charging roller 2 and the photosensitive drum 1. The structure and the function of the contact release of the charging roller 2 will be described hereinafter.

Figure 6:
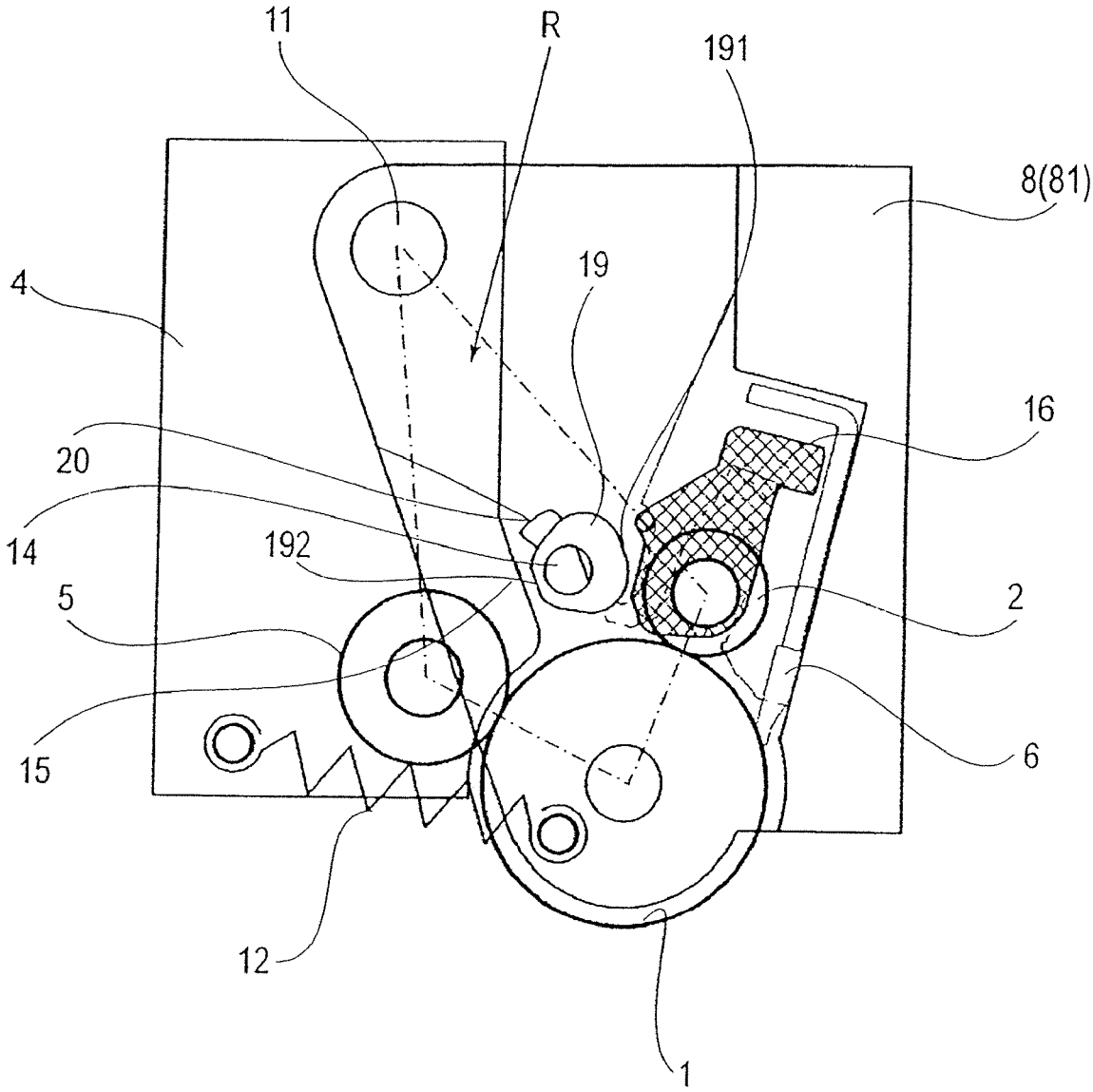
FIG. 6 is a sectional view of a process cartridge during the image forming operation according to an embodiment of the present invention.
Figure 7:
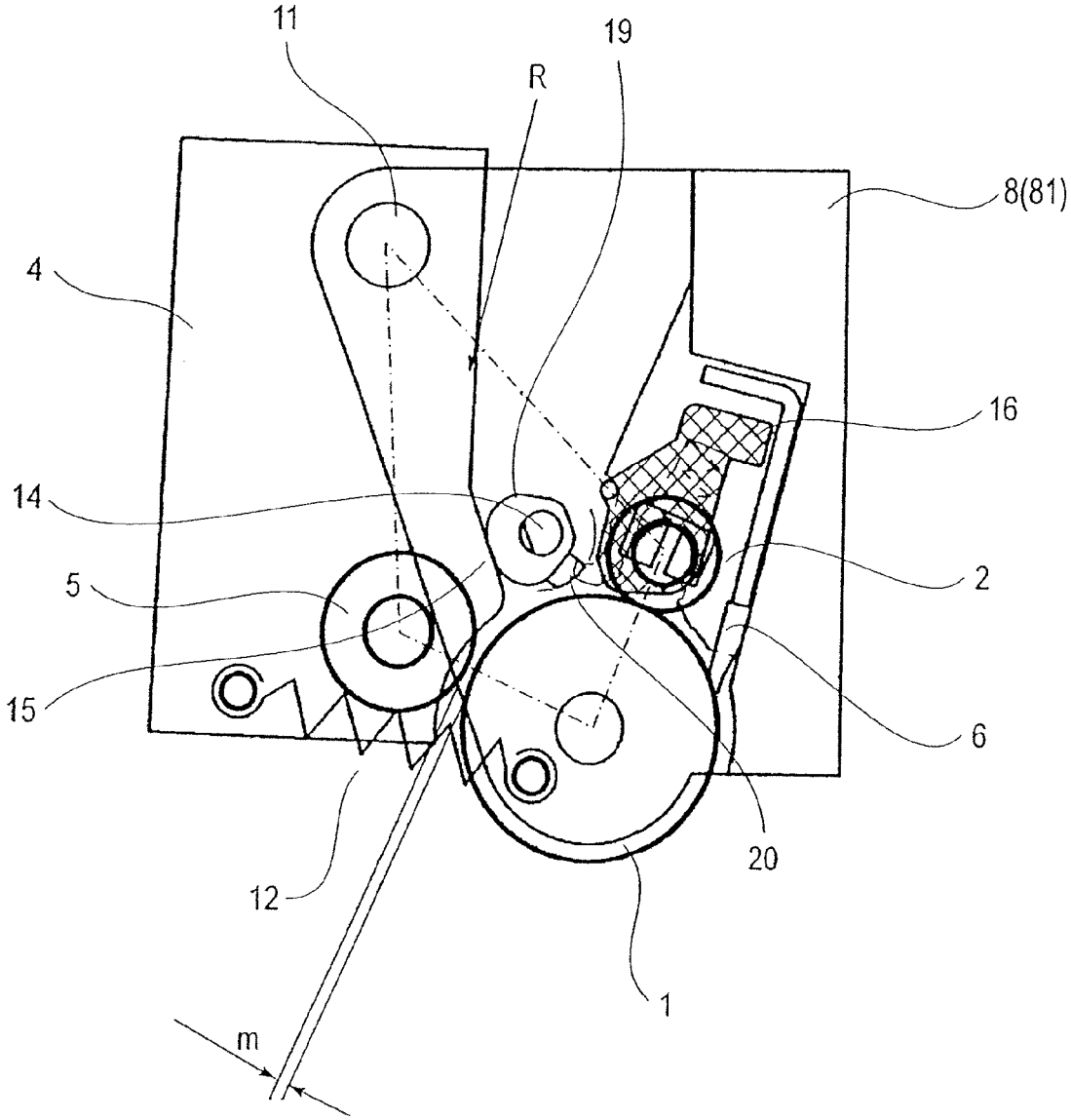
FIG. 7 is a sectional view of a process cartridge during the image forming operation being not carried out according to an embodiment of the present invention.

FIG. 6 shows a state in which the developing roller 5 and the photosensitive drum 1 are in contact with each other along the longitudinal direction. Here, the position of the developing unit 4 relative to the drum unit 8 in the state that developing roller 5 and the photosensitive drum 1 contact each other along the longitudinal direction, is called the "contact position". FIG. 7 shows a state in which the developing roller 5 is spaced from the photosensitive drum 1. Here, the position of the developing unit 4 relative to the drum unit 8 in the state in which the developing roller 5 and the photosensitive drum 1 are spaced from each other, is called the "spaced position". The cam 19 has a large diameter portion 191 and a small diameter portion 192. When the large diameter portion 191 is positioned at an angle where it is opposed to the surface 15 to be pressed, the large diameter portion 191 is in contact with the surface 15 to be pressed. The large diameter portion 191 urges the surface 15 to be pressed toward substantially a horizontal direction. At this time, the developing unit 4 is positioned at the spaced position (FIG. 7). And, the developing roller 5 is separated or spaced from the photosensitive drum 1. In FIG. 7, the distance of the spacing is indicated by "m". In this embodiment, the configuration of the cam 19 is set such that the spacing m is approximately 1 mm. The driving force receiving portion 10 receives the driving force for rotating the cam 19 from the main assembly 99 of the apparatus. By doing so, the cam 19 is rotated in the counterclockwise direction against the elastic force of the spring 12 from the position where the large diameter portion 191 is contacted to the surface 15 to be pressed. At this time, the developing unit 4 rotates in the counterclockwise direction about the shaft 11 by the elastic force of the spring 12. With the rotation of the developing unit 4, the spacing gradually decreases. Then, the small diameter portion 192 is opposed to the surface 15 to be pressed. As a result, the developing unit 4 is moved from the spaced position to the contact position (FIG. 6). In this state, the developing roller 5 contacts the photosensitive drum 1. More particularly, when the cam 19 rotates through 180° from the position where the large diameter portion 191 is contacted to the surface 15 to be pressed, the small diameter portion 192 is opposed to the surface 15 to be pressed. As a result, the developing unit 4 is moved from the spaced position to the contact position. When the developing unit 4 is at the contact position, the cam 19 is completely spaced from the surface 15 to be pressed. In summary, in the state that the cartridge 7 is mounted to the main assembly 99 of the apparatus, the developing unit 4 takes the contact position (FIG. 6) and the spaced position (FIG. 7) alternately by 180° rotation of the cam 19. Thus, the cam 19 is rotatable so as to move the developing unit 4 to and from the contact position and the spaced position.

The configuration of the outer periphery of the cam 19 is symmetrical with respect to a line. By this, the contact and spacing between the developing roller 5 and the photosensitive drum 1 are effected at the same timing irrespective of whether the rotational direction of the cam 19 is clockwise or counterclockwise. In addition, the configuration of the outer periphery of the cam 19 is a smooth curve. Therefore, the influence to the image by impact of contact and spacing can be minimized. More particularly, when they are brought into contact to each other, the surface 15 to be pressed gradually lowers along the smooth curved surface of the cam 19 in accordance with the rotation of the cam 19 by the elastic force of the spring 12. Therefore, the vibration upon the contact between them can be reduced. When the cartridge 7 alone is shipped and transported, the large diameter portion 191 is kept opposed to the surface 15 to be pressed by so setting the cam 19 position. The surface 15 to be pressed is a flat surface, and a part of the large diameter portion 191 is configured to a flat surface, correspondingly. When the cartridge 7 is shipped and transported, the flat surfaces are kept contacted, and the units 4, 8 are urged such that flat surfaces are pressed against each of by the elastic force of the spring 12. By doing so, the cam 19 is prevented from unintentionally rotating. Thus, unintentional rotation of the cam 19 during the transportation of the cartridge 7 is prevented, even upon vibration or the like. Thus, the contact between the developing roller 4 and the photosensitive drum 1 is prevented during transportation of the cartridge 7. When the cartridge 7 is mounted to the main assembly 99 of the apparatus, and the cam 19 is rotated by the driving force transmitted from the main assembly 99 of the apparatus, the developing unit is brought into the contact position from the spaced position. In this manner, according to the embodiment, a deformation of the elastic member 51, which may be caused by keeping for a long term the photosensitive drum 1 and the developing roller 5 contacted to each other along the longitudinal direction, can be suppressed. Since the cam 19 is disposed inside the frame 71 of the cartridge 7, the amount of displacement of the cam 19 to move the developing unit 4 between the contact position and the spaced position is reduced, as compared with the case in which the cam 19 is disposed in the main assembly 99 of the apparatus As described in the foregoing, the cam 19 is disposed in the region R (namely, adjacent to the developing roller 5 and to the photosensitive drum 1). Therefore, upon a determination of the amount of spacing between the developing roller 5 and the photosensitive drum 1, the attention to be paid to the amount of deformation of the parts such as the frame 71 of the cartridge 7 and to the influence of the tolerance or the like, can be minimized.

In this embodiment, the movable member has been described as being a cam as an example. However, the movable member is not inevitably a cam mechanism, but may be a crank mechanism or the like. The motion of the movable member is not limited to the rotational motion but may be a linear motion. As described in the foregoing, in the embodiment, by using the rotational motion of the cam, the space required by this mechanism can be reduced.

In this embodiment, the force for moving the developing unit 4 from the contact position to the spaced position is the urging force of the cam 19 against the portion 15 to be pressed. The force for moving the developing unit 4 from the spaced position the to the contact position is the elastic force of the spring 12. However, the forces for the motions are not limited to these examples, and they may be the other way around, that is, the former may be the urging force, and the latter may be the elastic force. In summary, the forces are the ones produced by movement of the movable member. The structure by which the movable member moves the developing unit between the contact position and the spaced position is not limited to a combination of a cam and a spring. Any structure is available if the developing unit is moved between the contact position and the spaced position in accordance with the movement of the movable member. For example, a crank mechanism or the like is usable. However, the structure of this embodiment wherein the developing unit 4 is moved to the spaced position by the cam 19, and the developing unit 4 is moved to the contact position by the spring 12, is preferable since then, the entering amount (depth of impression) of the photosensitive drum 1 into the developing roller 5 is stabilized.

Drive Transmission for Movable Member

Figure 8:
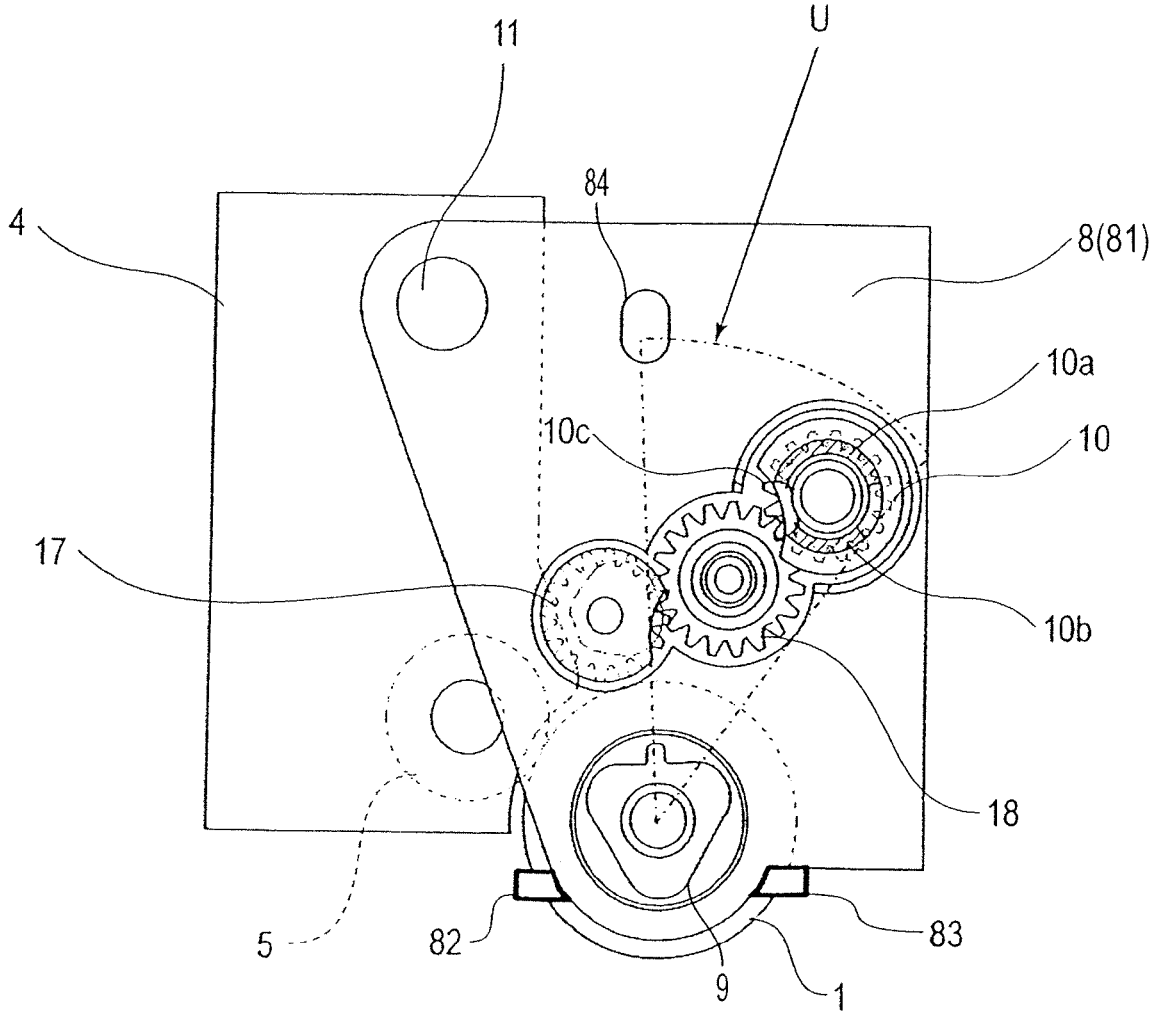
FIG. 8 is a side view of a process cartridge according to an embodiment of the present invention.

FIG. 8 is a side view of a front part of the process cartridge 7 with respect to the mounting direction. When the cartridge 7 is set in the main assembly 99 of the apparatus, the drum unit 8 is correctly positioned relative to the main assembly 99 of the apparatus. More particularly, a first portion to be positioned 82 and a second portion to be positioned 83 are provided on a bottom side of the drum unit 8 at a leading side of the drum unit 8 with respect to the mounting direction. At the trailing side with respect to the mounting direction, a first portion to be positioned 82 (unshown) and a second portion to be positioned 83 (unshown) are similarly provided on the drum unit 8. When the cartridge 7 is mounted to the mounting portion 101, the first portion to be positioned 82 and the second portion to be positioned 83 are positioned relative to the main assembly 99 of the apparatus at the leading side with respect to the mounting direction.

The leading side of the drum unit 8 is provided with a rotation preventing portion 84. The rotation preventing portion 84 abuts a rotation preventing portion (unshown) provided in the main assembly of the apparatus so that the drum unit 8 is prevented from rotating in a direction crossing with the mounting direction. The rotation preventing portion 84 thus prevents the drum unit 8 from rotating about the driving force receiving portion 9. A leading side of the drum unit 8 with respect to the mounting direction is provided with a movable member driving force receiving portion 10 which is rotatably mounted thereon. By the provision of the driving force receiving portion 10 in the drum unit 8 positioned in the main assembly 99 of the apparatus, the driving force for moving the developing unit 4 can be stably received. Furthermore, the driving force receiving portion 10 is disposed within a circle which is drawn about the center of rotation of the driving force receiving portion 9 with a radius which is equal to a shortest distance between the center of rotation and the rotation preventing portion 84. By doing so, the position of the driving force receiving portion 10 for receiving the driving force can be stabilized.

In addition, the drum unit 8 is provided, at the leading side with respect to the mounting direction, with a movable member gear 17 which is rotatable. The gear 17 is disposed at a longitudinal end of the shaft 14. The gear 17 is in meshing engagement with a gear portion 10*c* of the driving force receiving portion 10 through an idler gear 18. The numbers of the teeth of the gear 17 and the gear portion 10*c* are equal to each other, and more particularly, are 16, in this embodiment. By this, when the gear portion 10*c* rotates through one full turn, the gear 17 also rotates through one full turn. Thus, the rotational frequencies of the driving force receiving portion 10 and the shaft 14 correspond to each other one by one. The shaft 14 is rotated by rotation of the gear 17. The rotation of the shaft 14 rotates the cam 19. The cam 19 is fixed at one and the other ends of the shaft 14. In this embodiment, the driving force receiving portion 10 is in the form of a coupling (cartridge coupling). The coupling has a first projection 10*a* and second projection 10*b* projecting frontwardly with respect to the mounting direction. The first projection 10*a* and the second projection 10*b* are in the form of arcs having the same radii but different arcuation angles. The first projection 10*a* and the second projection 10*b* are projected in the form of a fork. The arcuation angle of the first projection 10*a* is 150°, and the arcuation angle of the second projection 10*b* is 90°.

Figure 9:
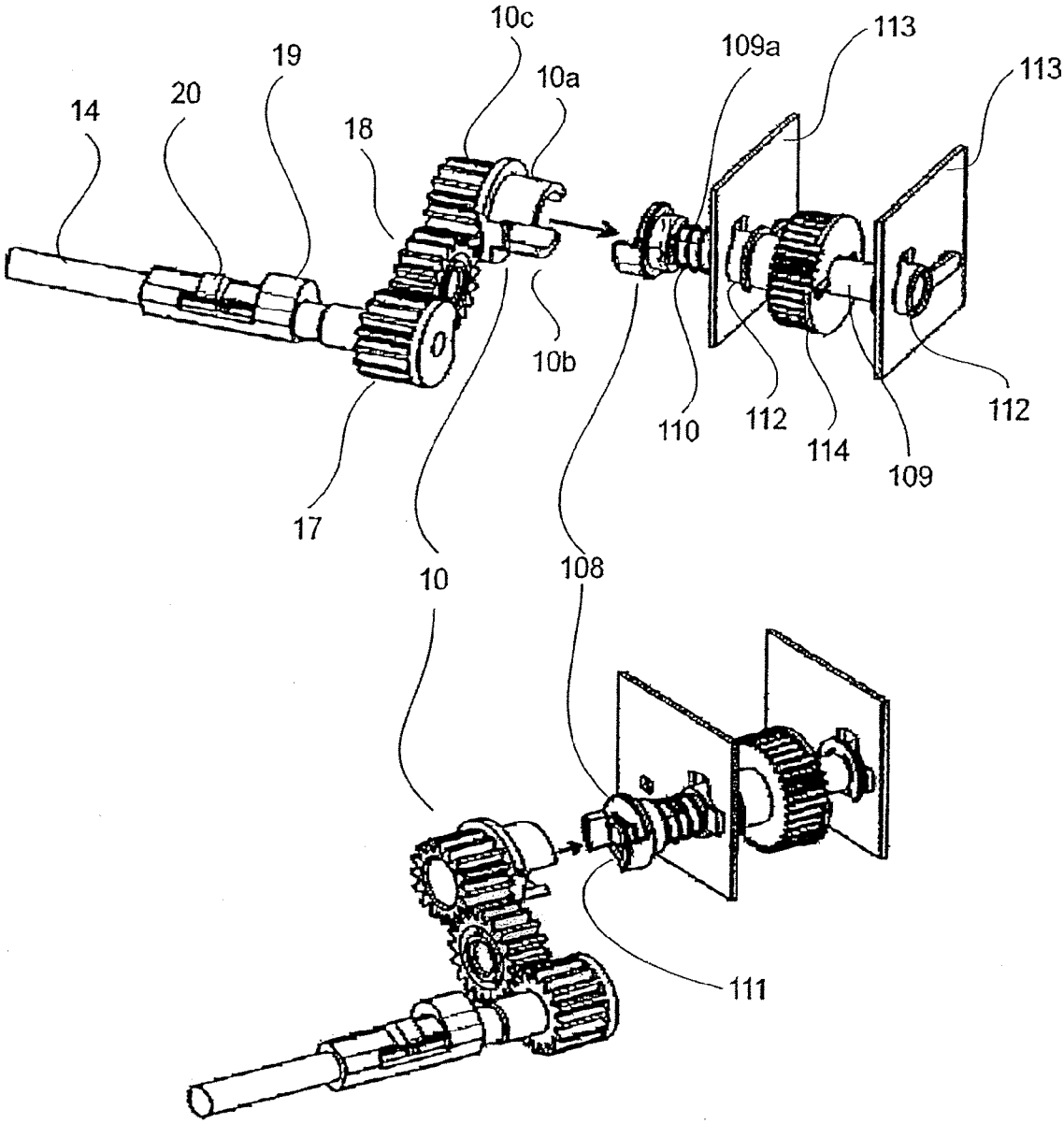
FIG. 9 shows a drive transmission structure of a movable member according to an embodiment of the present invention.

On the other hand, as shown in FIG. 9, the main assembly 99 of the apparatus has a driving force transmitting portion 108 for transmitting a driving force to the driving force receiving portion 10. In this embodiment, the driving force transmitting portion 108 is in the form of a coupling (main assembly coupling). When the cartridge 7 is mounted to the main assembly 99 of the apparatus, the transmitting portion 108 is opposed to the driving force receiving portion 10. The coupling (the transmitting portion 108) has two projections which are arcs having the same radii. The two projections are projected in the form of a fork. The two projections are in the form of arcs which are slightly smaller than the arcuation of the concave area between the first projection 10*a* and the second projection 10*b* of the driving force receiving portion 10. The driving force receiving portion 10 is engageable only at a predetermined angular relation relative to the transmitting portion 108, The inside of the transmitting portion 108 is provided with a D-shaped hole portion (unshown). The rotational shaft 109 is provided with a D-shaped projection 109*a*. The transmitting portion 108 is supported on the rotational shaft 109 slidably in the axial direction of the rotational shaft 109. The transmitting portion 108 is urged toward the cartridge 7 by a compression spring 110 disposed co-axially with the rotational shaft 109. The free end portion of the rotational shaft 109 is provided with an E-ring 111. The E-ring 111 is effective to prevent the transmitting portion 108 from disengaging from the rotational shaft 109.

The urging force of the spring 110 is set to be a minimum urging force to permit the transmitting portion 108 to slide on the other hand, with respect to the rotational direction of the rotational shaft 109, and the transmitting portion 108 and the rotational shaft 109 are integrally rotatable by the engagement between the hole portion of the transmitting portion and the projection 109*a*. The rotational shaft 109 is rotatably supported on a metal plate 113 through a bearing member 112. The bearing member 112 and the metal plate 113 are provided in the main assembly 99 of the apparatus. The rotational shaft 109 is connected with a gear 114, so that rotational shaft 109 and the gear 114 are integrally rotatable. The gear 114 is in meshing engagement with a motor gear (unshown). The main assembly 99 of the apparatus is provided with a sensor (unshown) for detecting an angle of rotation of the gear 114 at 0° and at 180°.

A description will be provided as to a coupling operation between the transmitting portion 108 and the driving force receiving portion 10. If the angular positions of the driving force receiving portion 10 and the transmitting portion 108 do not match when the cartridge 7 is mounted to the main assembly 99 of the apparatus, the transmitting portion 108 retracts in the axial direction of the rotational shaft 109. By rotation of the motor (unshown), the rotational shaft 109 and the transmitting portion 108 rotate integrally. The motor is provided in the main assembly 99 of the apparatus. When the transmitting portion 108 rotates to an angular position matching the driving force receiving portion 10, the transmitting portion 108 moves toward the driving force receiving portion 10 by the urging force of the spring 110. Then, the engagement between the transmitting portion 108 and the driving force receiving portion 10 is completed. Thus, the driving force becomes transportable from the transmitting portion 108 to the driving force receiving portion 10.

Thus, only by mounting the cartridge 7 to the main assembly 99 of the apparatus in the mounting direction and rotating the motor, the transmitting portion 108 and the driving force receiving portion 10 are brought into engagement with each other. Therefore, as compared with the case in which gears are used for operable engagement between the transmitting portion 108 and the driving force receiving portion 10, a particular operation for engaging them is unnecessary. Because of the use of the coupling member for the drive transmission between the transmitting portion 108 and the driving force receiving portion 10, they are engaged in the longitudinal direction. Therefore, the transmission mechanism does not obstruct the mounting manipulation of the cartridge 7 to the main assembly 99 of the apparatus.

The transmitting portion 108 and the driving force receiving portion 10 are engaged with each other only with a predetermined angular relation, and the rotational frequency of the driving force receiving portion 10 and that of the movable member 19 correspond to each other one by one. Therefore, the angle of the movable member 19 is detected by the sensor, and the control operation is carried out accordingly. More particularly, using the sensor, the control operation is possible such that developing roller 5 and the photosensitive drum 1 are contacted to each other during the image forming operation and the developing roller 5 and the photosensitive drum 1 are spaced from each other otherwise. By doing so, the possible permanent deformation of the elastic member of the developing roller 5 can be avoided. When the image forming operation is not carried out, the developing roller 5 is not rotated, thus minimizing the rotation time. Thus, the lifetime of the cartridge 7 can be extended.

According to this embodiment, by the provision, in the cartridge 7, of the cam 19 for contact and spacing between the developing roller 5 and the photosensitive drum 1, there is no need to provide a space to be occupied by the cam 19 in the main assembly 99 of the apparatus Particularly, in this embodiment, the cartridge 7 is mounted to the main assembly 99 of the apparatus in the direction which is parallel with the developing roller 5, and the cam 19 is disposed substantially between the developing unit 4 and the drum unit 8. Therefore, the cartridge 7 can be downsized even as compared with the case in which a member for moving the developing unit 4 is disposed outside the cartridge 7.

In this embodiment, the structure for transmitting the driving force to the photosensitive drum 1 and the structure for transmitting the driving force to the cam 19 use coupling mechanisms, but this is not inevitable. For example, gears are usable in place of the coupling mechanism. The coupling direction is not inevitably the same as the mounting direction of the cartridge 7 to the main assembly 99 of the apparatus. More particularly, the cartridge 7 may be mounted to the main assembly 99 of the apparatus in a direction crossing with the longitudinal direction of the cartridge 7. However, with the above-described structures, the advantageous effects described in the foregoing are provided.

Contact and Release of Charging Roller

A description will be provided as to a mechanism for contact and release between the charging roller 2 and the photosensitive drum 1.

Figure 11:
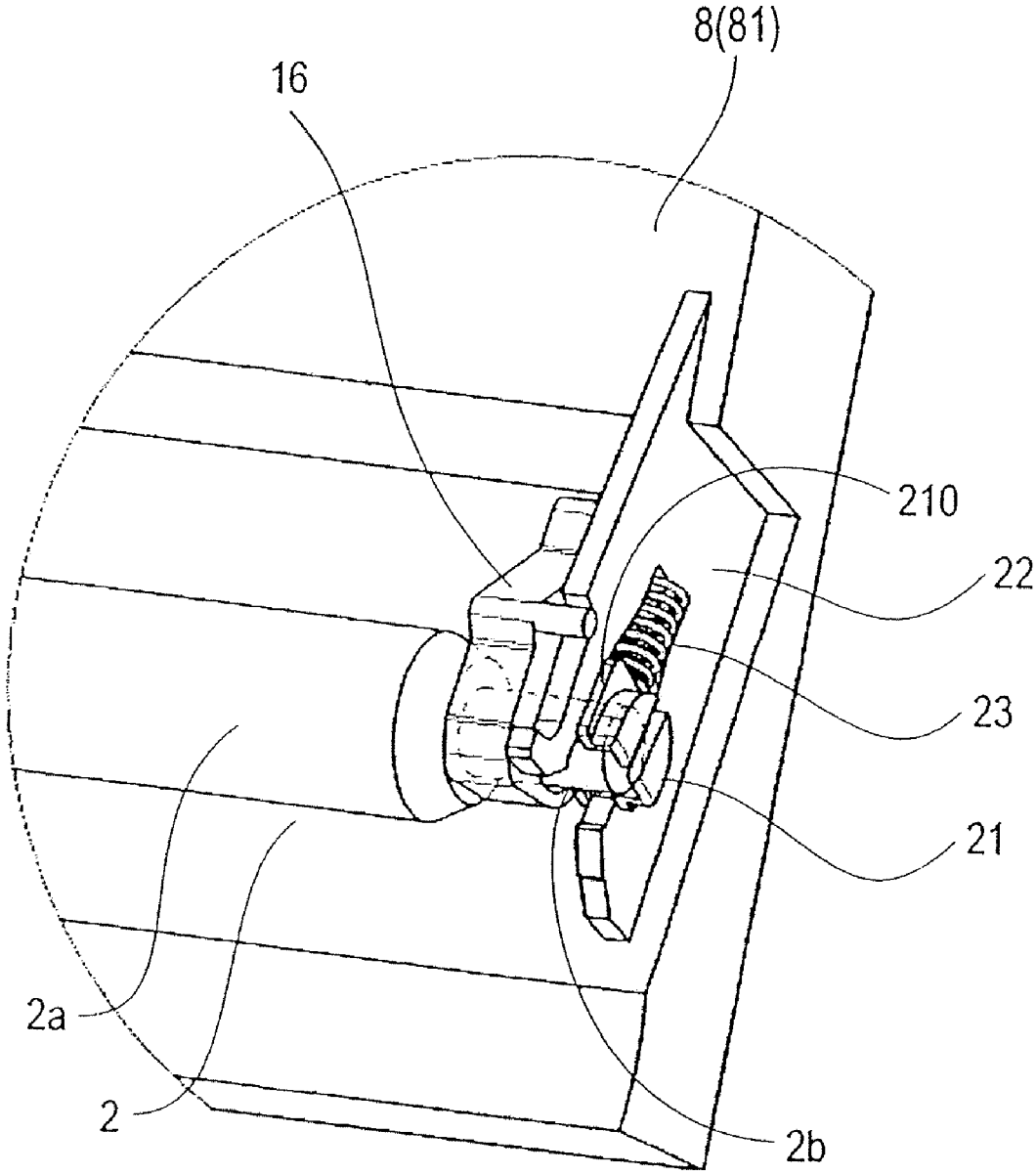
FIG. 11 shows a structure of a bearing for the charging roller according to an embodiment of the present invention.

Referring to FIG. 11, a description will be provided as to the structure for supporting a shaft of the charging roller 2. FIG. 11 is a perspective view of a longitudinal end of the charging roller 2. In this figure, only one end is shown for simplicity. However, the same applies to the other end.

The charging roller 2 comprises a metal shaft 2*b* and an elastic member 2*a* which are integrally molded. One end in the longitudinal direction is provided with a bearing member 21 which is in the form of a cap. The bearing member 21 rotatably supports the metal shaft 2*b*. A side surface of the bearing member 21 is provided with a guide groove 210 for guiding the bearing member 21. The guide groove 210 is slidable along a guiding rib 22 formed on the frame of the drum unit 8. In this manner, the charging roller 2 is movable in a direction parallel with a flat plane including an axis of the charging roller 2 and an axis of the photosensitive drum 1. A spring 23 is mounted on the frame 81, of the drum unit 8 and urges the bearing member 21 toward the photosensitive drum 1. By doing so, the charging roller 2 and the photosensitive drum 1 are contacted to each other.

A contact and release block 16, which will hereinafter be called simply a "block", is rotatably supported on the metal shaft 2*b*. An attitude of the block 16 with which the charging roller 2 is contacted to the photosensitive drum 1, thus enabling the image forming operation, is called a "first attitude" And, the position of the charging roller 2 relative to the photosensitive drum 1 in such a state is called a "first position" An attitude of the block 16 with which the charging roller 2 is spaced from the photosensitive drum 1 is called, a "second attitude" And, the position of the charging roller 2 relative to the photosensitive drum 1 in such a state is called a "second position".

Figure 12:
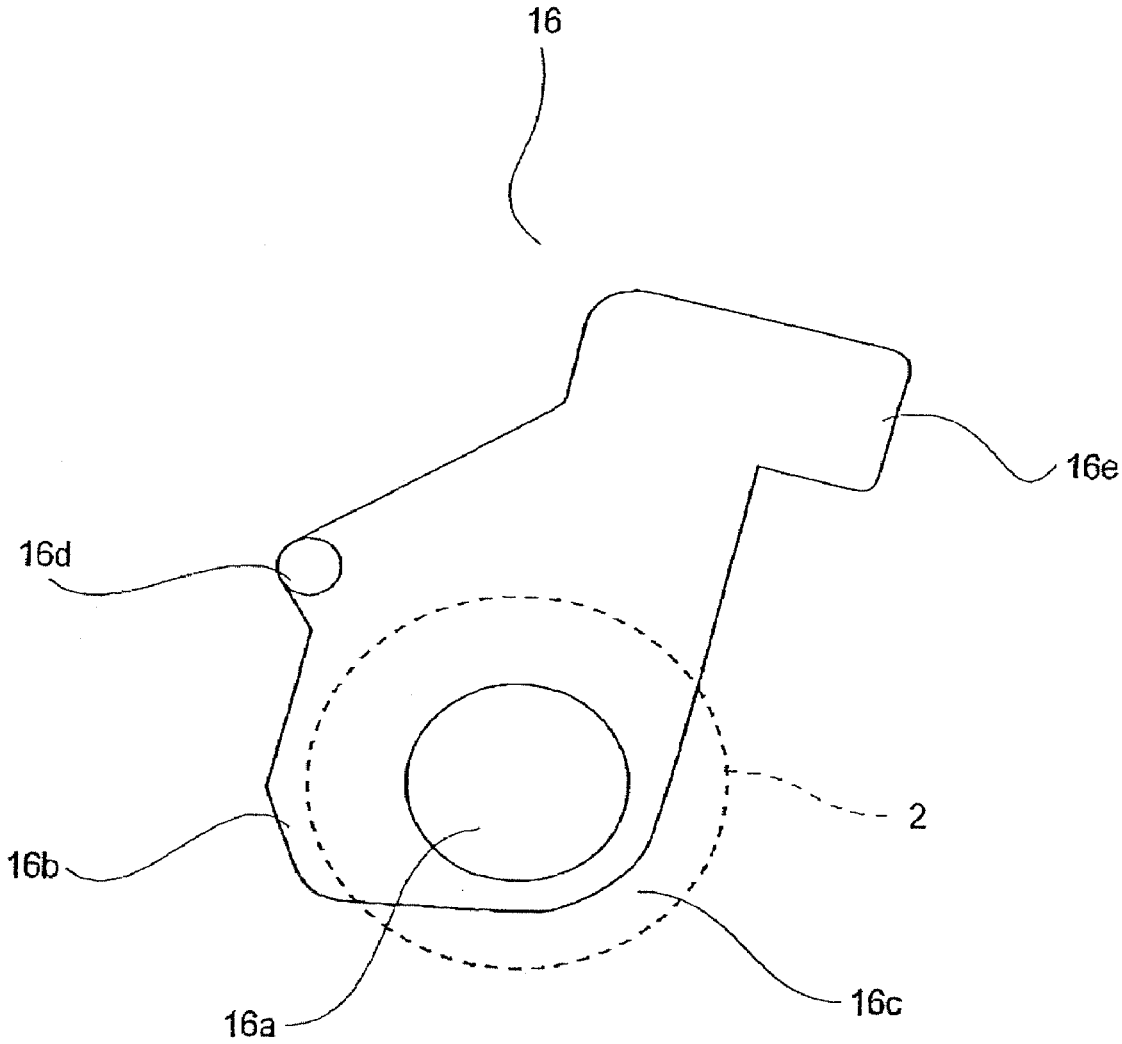
FIG. 12 is a side view of a contact and releasing block of a FIG. 12 according to an embodiment of the present invention.

The block 16 is provided between the elastic member 2*a* and the bearing member 21. FIG. 12 shows a configuration of the block 16. In FIG. 12, a circle indicated by broken line is an outer diameter of the charging roller 2. A hole 16*a* formed at the central portion of the block 16 is engaged with the metal shaft 2*b*. The outer surface of the block 16 has a first outer surface 16*b* and a second outer surface 16*c*. Here, the first outer surface 16*b* is in a region outside the outer surface of the charging roller 2 with respect to a radial direction of the charging roller 2. The second outer surface 16*c* is disposed in a region inside the outer surface of the charging roller 2 with respect to the radial direction. When the cartridge 7 is to be used, the second outer surface 16*c* is opposed to the photosensitive drum 1. At this time, the charging roller 2 presses against the photosensitive drum 1.

Figure 10:
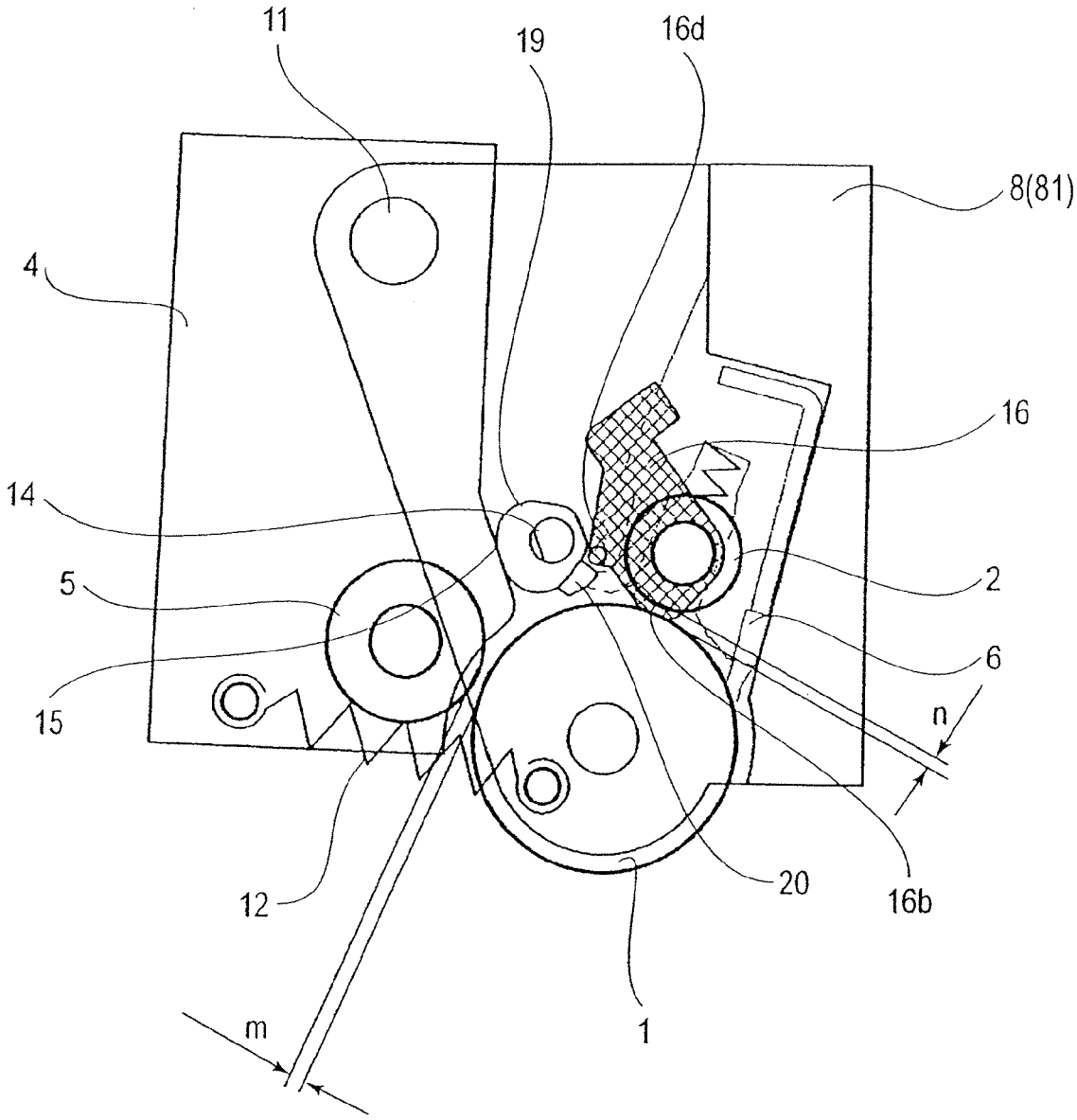
FIG. 10 is a sectional view of a process cartridge according to an embodiment of the present invention during transportation when it is to be shipped.

As shown in FIG. 10, when the first outer surface 16*b* is opposed to the photosensitive drum 1, the first outer surface 16*b* contacts the photosensitive drum 1. By doing so, the charging roller 2 is separated from the photosensitive drum 1. Namely, the contact of the charging roller 2 to the photosensitive drum 1 is released. The first outer surface 16*b* has a curved surface with the same curvature as the curvature of the photosensitive drum 1. Therefore, when the block 16 is stationary at its the second attitude, the position of the block 16 is stabilized. Thus, the block 16 is prevented from deviating from the second attitude by vibrations imparted during transportation of the cartridge 7.

Figure 5:
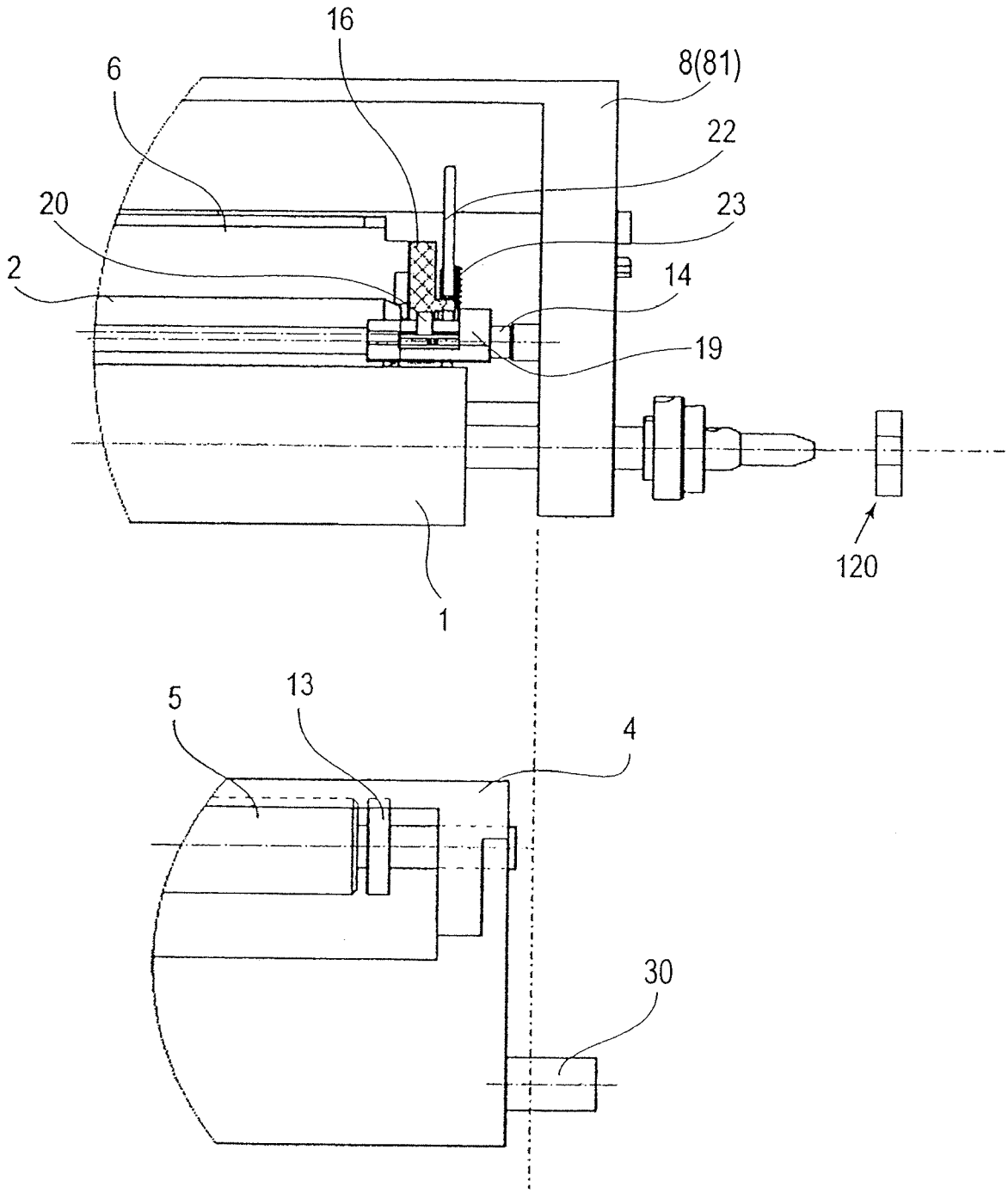
FIG. 5 is a front view of a drum unit and a developing unit according to an embodiment of the present invention.

The block 16 has a projection 16*d*. The projection 16*d* is projected toward a position of the shaft 14 when it takes the first attitude The shaft 14 is provided with a projection 20 at a position opposing to the projection 16*d*. As shown in FIG. 5, the projection 20 is disposed at a position nearer to the center of the cartridge 7 than the cam 19 with respect to the longitudinal direction of the cartridge 7. The projection 20 and the surface 15 to be pressed are deviated in position in the longitudinal direction. Therefore, the projection 20 and surface 15 to be pressed do not interfere with each other. Similarly, the cam 19 and the block 16 are deviated in position with respect to the longitudinal direction. So, the cam 19 and the block 16 do not interfere with each other.

FIG. 9 shows a state of the cartridge 7 before mounting to the main assembly 99 of the apparatus. In FIG. 9, the developing roller 5 and the photosensitive drum 1 are spaced from each other by a predetermined gap m. In addition, the charging roller 2 and the photosensitive drum 1 are spaced from each other by a gap n, shown in FIG. 10. Thus, the charging roller 2 is at the second position. With this state, the shaft 14 is rotated in the counterclockwise direction. By doing so, a projection 20 of the shaft 14 is contacted to the projection 16*d*. The block 16 rotates in the clockwise direction about an axis of the charging roller 2. And, the block 16 takes the first attitude in which the second outer surface 16*c* is opposed to the photosensitive drum 1. The charging roller 2 is released from limitation by the first outer surface 16*b*. As a result, the charging roller 2 is urged to the photosensitive drum 1 by an urging force of the spring 23.

And, the urging between the cam 19 and the surface 15 to be pressed is released, so that the developing roller 5 and the photosensitive drum 1 are spaced from each other, simultaneously with the urging of the charging roller 2 to the photosensitive drum 1. By this, the developing roller 5 and the photosensitive drum 1 are brought into contact to each other. Thus, the image forming operation is enabled. Once the block 16 takes the first attitude, the attitude of the block 16 is maintained by a rotation stopper 16*e* and the apex formed by the boundary between the first outer surface 16*b* and the second outer surface 16*c*. When the first attitude is taken, the block 16 does not interfere with a rotational radius of the projection 20 of the shaft 14.

As shown in FIG. 10, when the cartridge 7 alone is shipped, the charging roller 2 is kept out of contact with the photosensitive drum 1. In such a state, the user mounts the cartridge 7 to the main assembly 99 of the apparatus. In the initial operation of the main assembly 99 of the apparatus, the driving force transmitting portion 108 is rotated in a predetermined direction. By this, as shown in FIGS. 6, 7, the charging roller 2 is brought into contact to the photosensitive drum 1.

Accordingly, the possible deformation of the charging roller 2 and possible memory arising in the photosensitive drum 1, which are caused by vibrations of the cartridge 7 or long term storage of the cartridge 7 when the cartridge 7 is shipped (particularly, when the cartridge 7 alone is shipped) can be prevented. In addition, the charging roller 2 can be automatically put into an urging state to enable the image forming operation without imparting cumbersome operations on the user.

In this embodiment, the charging roller 2 and the photosensitive drum 1 are completely spaced at the second position. However, the complete spacing is not inevitable. More particularly, it will suffice if the distance between the axis of the photosensitive drum 1 and the axis of the charging roller 2 is larger in the second position than in the first position. By the block 16 receiving a part of the urging force applied between the photosensitive drum 1 and the charging roller 2, the possible problems (the permanent deformation of the charging roller 2 or the memory produced in the photosensitive drum) can be eased. However, when they are completely spaced, these the problems can be completely eliminated.

In this embodiment, the developing unit 4 has the structures described in the foregoing. However, the developing unit is not limited to such a structure. For example, the developing unit may be the one having only a function of supporting the developing roller 5.

The structure of the process cartridge is not limited to those described in the foregoing. For example, the cleaning member as the process means and/or the charging roller may be omitted. The process cartridge of the present invention includes at least an electrophotographic photosensitive drum and a developing roller as a process means.

According to the present invention, as described in the foregoing, the positional accuracy between the developing unit and the movable member, which is movable to move the developing unit, when the process cartridge is set in the main assembly of the electrophotographic image forming apparatus, can be improved.

In addition, the present invention can lighten the load required when the process cartridge is mounted to the main assembly of the electrophotographic image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 086041/2005 filed Mar. 24, 2005, which is hereby incorporated by reference.

What is claimed is:

1. A process cartridge detachably mountable to a main assembly of an electrophotographic image forming apparatus, said process cartridge comprising:

an electrophotographic photosensitive drum;

a developing roller configured and positioned to develop an electrostatic latent image formed on said electrophotographic photosensitive drum with a developer while being in contact with said electrophotographic photosensitive drum;

a drum unit configured and positioned to support said electrophotographic photosensitive drum, wherein said drum unit is positioned relative to the main assembly of the apparatus when said process cartridge is set in the main assembly of the apparatus;

a developing unit supporting said developing roller and movable relative to said drum unit between a contact position in which said developing roller and said electrophotographic photosensitive drum are in contact to each other to develop the electrostatic latent image and a spaced position in which said developing roller and said electrophotographic photosensitive drum are spaced away from each other;

a movable member which is movable to move said developing unit between the contact position and the spaced position; and a movable member driving force receiving portion, provided in said drum unit, configured and positioned to receive, from the main assembly of the apparatus, a movable member driving force for moving said movable member when said process cartridge is mounted in the main assembly of the apparatus.

2. A process cartridge according to claim 1, wherein said movable member is provided between said drum unit and said developing unit.

3. A process cartridge according to claim 1 or 2, wherein said process cartridge is detachably mountable to the main assembly of the apparatus in a longitudinal direction of said electrophotographic photosensitive drum, and wherein said movable member driving force receiving portion is disposed at a leading end portion of said process cartridge with respect to a mounting direction in which said process cartridge is mounted to the main assembly of the apparatus.

4. A process cartridge according to claim 3, wherein said process cartridge contains a charging roller, supported in said drum unit, configured and positioned to charge a peripheral surface of said electrophotographic photosensitive drum, and said drum unit and said developing unit are coupled rotatably about a shaft, and wherein as seen in the mounting direction, said movable member is disposed in a region substantially surrounded by an axis of said electrophotographic photosensitive drum, an axis of said developing roller, an axis of said charging roller, and an axis of the shaft.

5. A process cartridge according to claims 1 or 2, wherein said movable member includes a cam which is rotatable by receiving a cam driving force which is said movable member driving force, from the main assembly of the apparatus, thus moving said developing unit from the contact position to the spaced position.

6. A process cartridge according to claim 1 or 2, further comprising an elastic member configured and positioned to apply an elastic force between said drum unit and said developing unit to move said developing unit from the spaced position to the contact position.

7. A process cartridge according to claim 1, further comprising:

a charging roller configured and positioned to charge said electrophotographic photosensitive drum, said charging roller being movable between a first position for contacting to said electrophotographic photosensitive drum to charge said electrophotographic photosensitive drum and a second position in which a distance between an axis of said electrophotographic photosensitive drum and an axis of said charging roller is larger than a distance therebetween when said charging roller takes the first position; and a charging roller movable member configured and positioned to move said charging roller from the second position to the first position, wherein said charging roller movable member moves said charging roller from the second position to the first position in interrelation with movement of said movable member.

8. An electrophotographic image forming apparatus for forming an image on a recording material, to which a process cartridge is detachably mountable, said apparatus comprising:

i) a positioning portion; and ii) a movable member driving force transmitting portion, wherein the process cartridge includes an electrophotographic photosensitive drum, a developing roller configured and positioned to develop an electrostatic latent image formed on the electrophotographic photosensitive drum with a developer while being in contact with the electrophotographic photosensitive drum, a drum unit configured and positioned to support the electrophotographic photosensitive drum, wherein the drum unit is positioned relative to said positioning portion when said the process cartridge is set in the main assembly of said apparatus, a developing unit supporting the developing roller and movable relative to the drum unit between a contact position in which the developing roller and the electrophotographic photosensitive drum are in contact to with each other to develop the electrostatic latent image and a spaced position in which the developing roller and the electrophotographic photosensitive drum are spaced away from each other, a movable member which is movable to move the developing unit between the contact position and the spaced position, and a movable member driving force receiving portion provided in the drum unit, configured and positioned to receive, from said movable driving force transmitting portion, a movable member driving force for moving the movable member when the process cartridge is mounted in the main assembly of said apparatus.

* * * * *

UNITED STATES PATENT AND TRADEMARK OFFICE

CERTIFICATE OF CORRECTION

PATENT NO. : 7,319,834 B2
APPLICATION NO. : 11/611974
DATED : January 15, 2008
INVENTOR(S) : Koji Yamaguchi et al.

It is certified that error appears in the above-identified patent and that said Letters Patent is hereby corrected as shown below:

COLUMN 2
Line 16, “support” should read --supporting--.
Line 23, “to” (first occurrence) should read --with--.

COLUMN 4
Line 15, “to” should read --with--.

COLUMN 8
Line 8, “to” (first occurrence) should read --with--.
Line 40, “apparatus” should read --apparatus.--.
Line 61, “the” (first occurrence) should be deleted.

COLUMN 10
Line 26, “portion 108,” should read --portion 108.--.

Signed and Sealed this

Seventeenth Day of February, 2009

JOHN DOLL
*Acting Director of the United States Patent and Trademark Office*